US009044115B1

(12) United States Patent
Chirigotis

(10) Patent No.: US 9,044,115 B1
(45) Date of Patent: Jun. 2, 2015

(54) SHOWER CURTAIN ENHANCER

(71) Applicant: Nicholas Chirigotis, New Bedford, MA (US)

(72) Inventor: Nicholas Chirigotis, New Bedford, MA (US)

( * ) Notice: Subject to any disclaimer, the term of this patent is extended or adjusted under 35 U.S.C. 154(b) by 0 days.

(21) Appl. No.: 14/270,876

(22) Filed: May 6, 2014

Related U.S. Application Data

(63) Continuation-in-part of application No. 14/203,692, filed on Mar. 11, 2014, now abandoned.

(60) Provisional application No. 61/892,620, filed on Oct. 18, 2013.

(51) Int. Cl.

| | |
|---|---|
| ***A47K 3/022*** | (2006.01) |
| ***A47K 3/34*** | (2006.01) |
| ***A47K 3/36*** | (2006.01) |
| ***A47H 1/02*** | (2006.01) |

(52) U.S. Cl.
CPC ..... *A47H 1/02* (2013.01); *A47H 2001/0205* (2013.01)

(58) Field of Classification Search
CPC ..... A47K 3/38
USPC ..... 4/607–610; 16/87.6 R, 87.8; 211/105.2
See application file for complete search history.

(56) References Cited

U.S. PATENT DOCUMENTS

| | | | | |
|---|---|---|---|---|
| 4,229,842 | A * | 10/1980 | Gilmore | 4/610 |
| 4,496,059 | A * | 1/1985 | Leiter | 4/610 |
| 5,007,120 | A | 4/1991 | Annand | |
| 5,103,531 | A | 4/1992 | Perrotta | |
| 5,662,297 | A | 9/1997 | Christensen et al. | |
| 5,732,420 | A | 3/1998 | Micciche | |
| 5,771,504 | A | 6/1998 | Steiner | |
| 6,263,523 | B1 | 7/2001 | Moore | |
| 6,694,543 | B2 * | 2/2004 | Moore | 4/610 |
| 6,996,862 | B1 | 2/2006 | Shippy et al. | |
| 8,185,981 | B2 | 5/2012 | Didehvar et al. | |
| 8,201,286 | B1 | 6/2012 | Parker | |
| 8,215,501 | B2 * | 7/2012 | Trettin et al. | 211/105.2 |
| 2007/0006378 | A1 | 1/2007 | Moore | |
| 2007/0174956 | A1 | 8/2007 | Heaslip | |
| 2012/0023657 | A1 | 2/2012 | Didehvar et al. | |

* cited by examiner

*Primary Examiner* — Tuan N Nguyen
(74) *Attorney, Agent, or Firm* — Salter & Michaelson

(57) ABSTRACT

A shower curtain enlarger apparatus that includes a flexible rod that is constructed and arranged for positioning between opposed side walls of a shower stall, and a pair of end pieces attached respectively to opposed ends of the flexible rod. The combined length of the flexible rod with the attached end pieces is constructed and arranged to have a length greater than the distance between the opposed side walls of the shower stall. The flexible rod is positioned between the opposed side walls by means of bending the flexible rod to fit between the opposed side walls and with the bending being directed away from the shower stall to enhance an inner use space in the shower stall. Other versions employ a hinge member or a wedge member.

19 Claims, 21 Drawing Sheets

SHOWER CURTAIN ENHANCER

RELATED CASE

This application is a continuation-in-part (CIP) of U.S. Ser. No. 14/203,692 filed on Mar. 11, 2014 and priority for that application is hereby claimed under 35 U.S.C. §119(e) to commonly owned U.S. Provisional Patent Application No. 61/892,620 which was filed on Oct. 18, 2013 and each of which is incorporated by reference herein in its entirety.

FIELD OF THE INVENTION

The present invention relates in general to a shower curtain apparatus and pertains more particularly to a device that enhances the use of the shower by expanding the size available within the shower. This is referred to herein as a shower curtain enhancer or enlarger.

BACKGROUND OF THE INVENTION

When a shower is used either as a single shower structure or as a completed bathtub enclosure, it is typical to have a shower curtain with a portion thereof extending inside of the tub enclosure. This restricts the available use inside the enclosure.

Accordingly, it is an object of the present invention to provide a shower curtain enhancer that can be readily secured adjacent to the shower curtain for extending the shower curtain outwardly to provide additional room inside of the enclosure for the purpose of showering.

SUMMARY OF THE INVENTION

To accomplish the foregoing and other objects, features and advantages of the present invention there is provided a shower curtain enlarger apparatus that comprises a flexible rod that is constructed and arranged for positioning between opposed side walls of a shower stall, and a pair of end pieces attached respectively to opposed ends of the flexible rod. The combined length of the flexible rod with the attached end pieces is constructed and arranged to have a length greater than the distance between the opposed side walls of the shower stall so as to provide a bulging out fo the rod and associated curtain. The flexible rod is positioned between the opposed side walls by means of bending the flexible rod to fit between the opposed side walls and with the bending being directed away from the shower stall to enhance the size of an inner use space in the shower stall.

In accordance with other aspects of the present invention the end piece comprises a cushioning member; including one or more extender pieces attached to the cushioning member to extend the combined length of the flexible rod and cushioning members; each of the extender pieces has an adhesive with a peel-off member; the end piece comprises a hinge piece; each hinge piece includes a base hinge piece and a pad member for engagement with the shower stall side wall; the end piece comprises a flexible retaining member; the flexible retaining member comprises an outer rubber piece and an inner metal piece supporting the outer rubber piece; further including a wedge member that is secured to the shower stall sidewall and having a ramp surface for receiving the end piece; including a wedge member secured to opposed side walls, and wherein the ramp surface is positioned in the same direction on both wedge members; the ramp surface has an edge lip that is useful in retaining the end piece on the flexible rod in place; the end piece comprises a cushioning member having multiple straight sides; the lip on the wedge member has a straight edge that is engaged by one of the straight sides of the cushioning member; the lip extends alongside of the ramp surface; and the cushioning member is one of square, rectangular and triangular.

In accordance with another embodiment of the present invention there is provided a method of installing a shower curtain enlarger apparatus that includes a flexible rod that is constructed and arranged for positioning between opposed side walls of a shower stall, and a pair of end pieces attached respectively to opposed ends of the flexible rod. The combined length of the flexible rod with the attached end pieces is constructed and arranged to have a length greater than the distance between the opposed side walls of the shower stall. The method includes positioning the flexible rod between the opposed side walls and bending the flexible rod to fit between the opposed side walls and with the bending being directed away from the shower stall to enhance an inner use space in the shower stall.

In accordance with still another embodiment of the present invention there is provided a method of installing a shower curtain enlarger apparatus that includes a flexible rod that is constructed and arranged for positioning between opposed side walls of a shower stall, a pair of end pieces attached respectively to opposed ends of the flexible rod, and a wedge member mounted at a side wall of the shower stall. The method includes positioning the flexible rod between the opposed side walls and bending the flexible rod to fit between the opposed side walls by sliding the end pieces along the wedge member so that the flexible rod bends away from the shower stall to enhance an inner use space in the shower stall.

In accordance with still other aspects of the present invention including providing a pair of wedge members, one mounted to each of opposed side walls of the shower stall; including sliding respective end pieces along respective wedge members; and including sliding a straight side of the end piece along a straight edge of the lip.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

In accordance with the present invention, there is provided, in one embodiment thereof, a flexible rod that preferably has rubber-like cushions at either end. This rod is preferably a little longer than the length of the tub enclosure, although for on embodiment they may be approximately the same length. The flexing of the rod in placing about eye level on the extreme outer edge of the enclosure enables the rod to bulge outwardly away from the showering space giving the user more room to shower. To make more room in the showering area, using plastic or rubber ends that are preferably flat on the ends enable the rod to grip the shower wall firmly while the rod bends in the middle. Moreover, by using varying thicknesses of extenders, the rod can be flexed more or less. By adding extenders, the rod is flexed more, providing additional space in the showering area. Each of these extenders may be comprised of a disc-like member having glue on one side and a design with a gripping surface on the other side. A wedge arrangement is also shown using at least one end wedge that the end pieces engage. By providing the wedge member the bowing out of the rod occurs by means of a sliding action of the end piece along a ramp of the wedge member, as to be described hereinafter.

Figure 1:
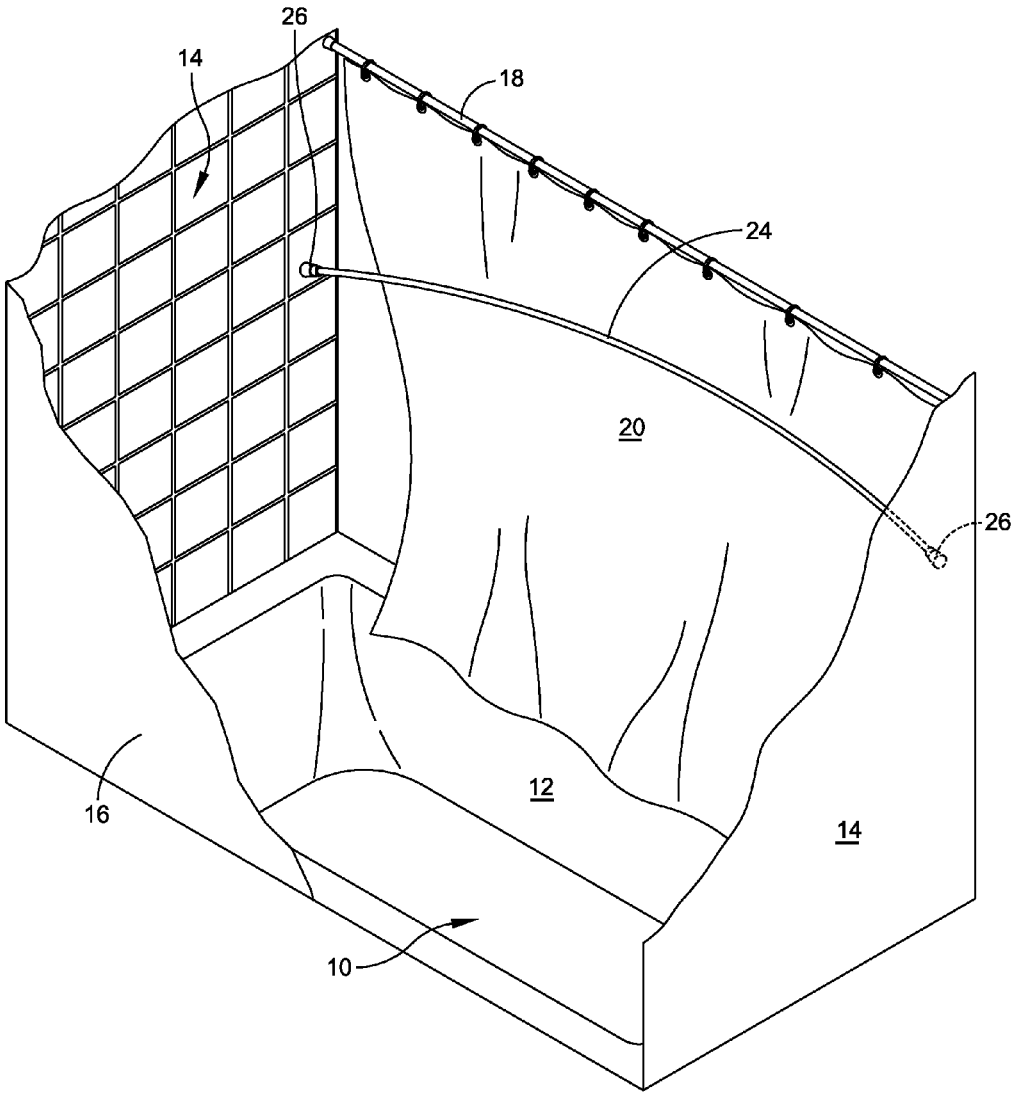
FIG. 1 is a perspective view illustrating the shower curtain enhancer of the present invention as used in a tub enclosure.
Figure 2:
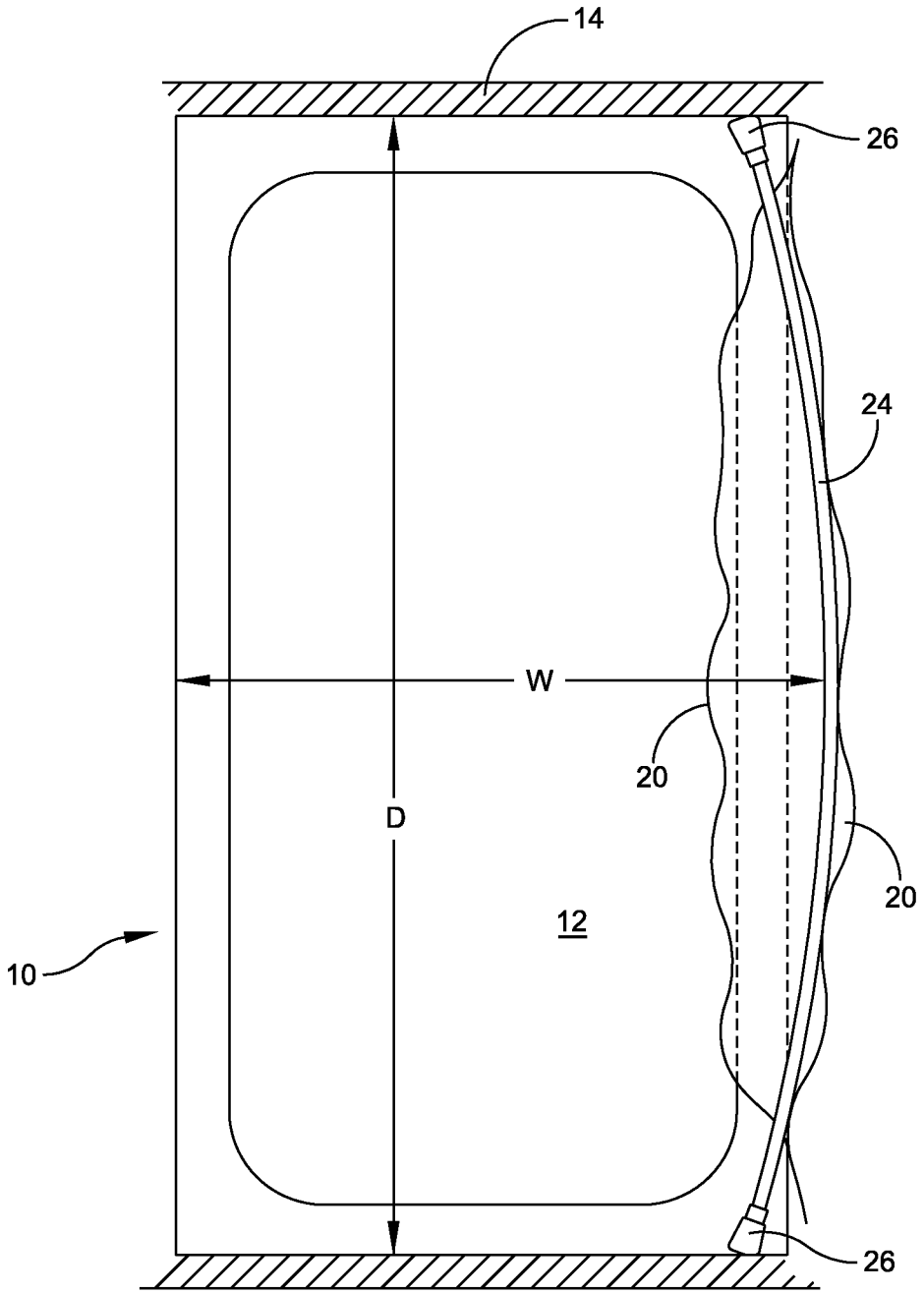
FIG. 2 is a plan view of the enhancer of FIG. 1 illustrating clearly the manner in which the rod enables an increase in the size of the showering area.

Reference is now made to the drawings, and initially to FIGS. 1 and 2 that show a bathtub enclosure 10 that may be considered as of conventional design, including a tub part 12 and opposed end sidewalls 14. In FIG. 1 there is also illustrated a portion of a rear wall 16. A conventional shower rod 18 is illustrated for supporting the shower curtain 20. The shower curtain 20 is typically a 2-layer curtain in which an outer layer is meant to be disposed outside of the tub and an inner layer, as illustrated in FIG. 1, is draped inside of the tub stall or enclosure 12.

Figure 3:
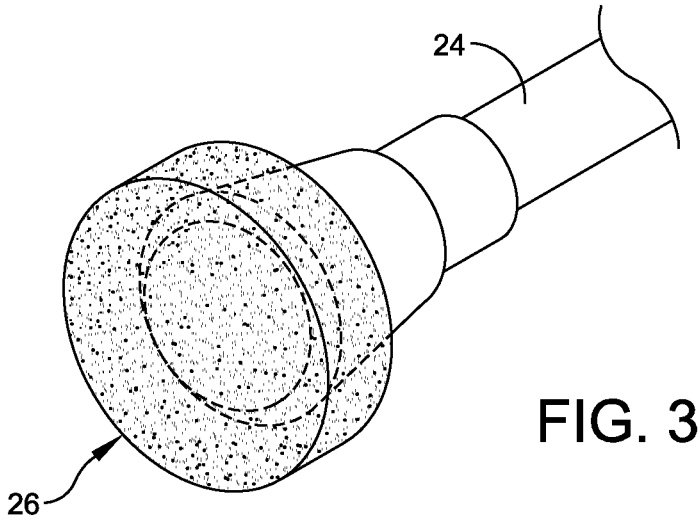
FIG. 3 is a fragmentary perspective view illustrating one version of an end of the flexible rod.
Figure 4:
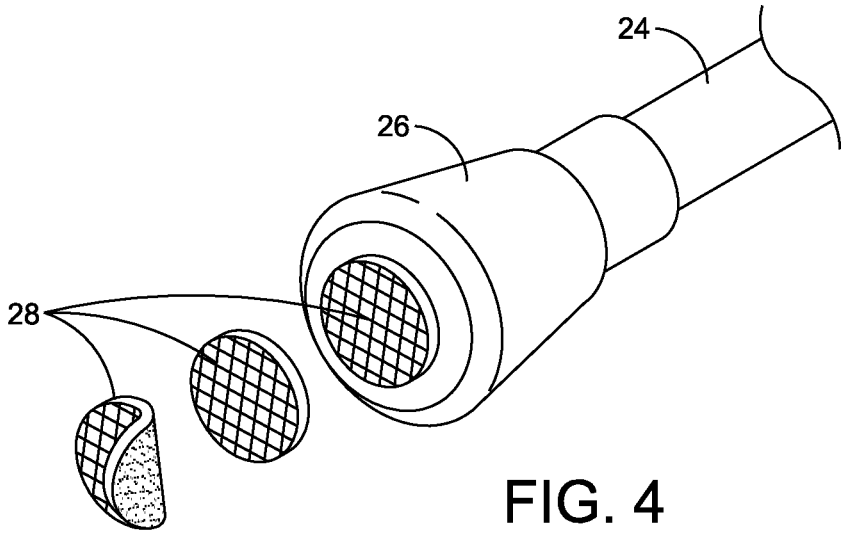
FIG. 4 is a fragmentary perspective view showing the use of extenders for extending the length of the rod.

Now, in accordance with the present invention, there is illustrated in FIGS. 1 and 2 the flexible rod 24. The rod 24 may be constructed of a number of different materials, including lightweight metal materials and plastics. The flexible rod 24 is constructed so that it can readily bend and is provided at opposed ends with cushion members 26. Each of these cushion members preferably has a surface, such as depicted in FIGS. 3 and 4 so that it can firmly grip an inside surface of each of the side walls 14. As noted in FIGS. 1 and 2, the length of the flexible rod 24 is longer than the distance D between the inner surfaces of the side walls. By flexing the rod 24 into a curved configuration as illustrated in FIGS. 1 and 2, this causes a bulging out of the flexible rod against the shower curtain 20 to provide an enhanced showering area having a maximum width illustrated at W in FIG. 2.

The end cushioning members may be as illustrated in FIG. 3, including an enlarged cushioned end that may be constructed of a soft rubber-like material. Refer also to the fragmentary perspective view of FIG. 4 that shows the possible addition of further extenders 28 that may have an adhesive on one side, preferably with some type of a peel-off member. These extenders 28 may be stacked on top of each other to change to overall length of the flexible rod so as to provide an optimum curvature to enhance the overall showering space.

Figure 5:
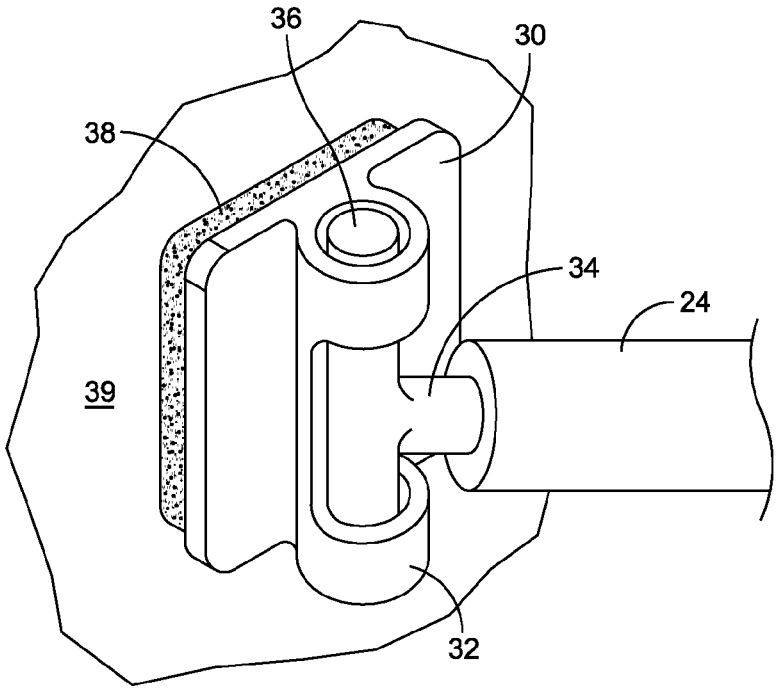
FIG. 5 is a fragmentary perspective view of an alternate embodiment employing, additionally, a hinge arrangement.
Figure 6:
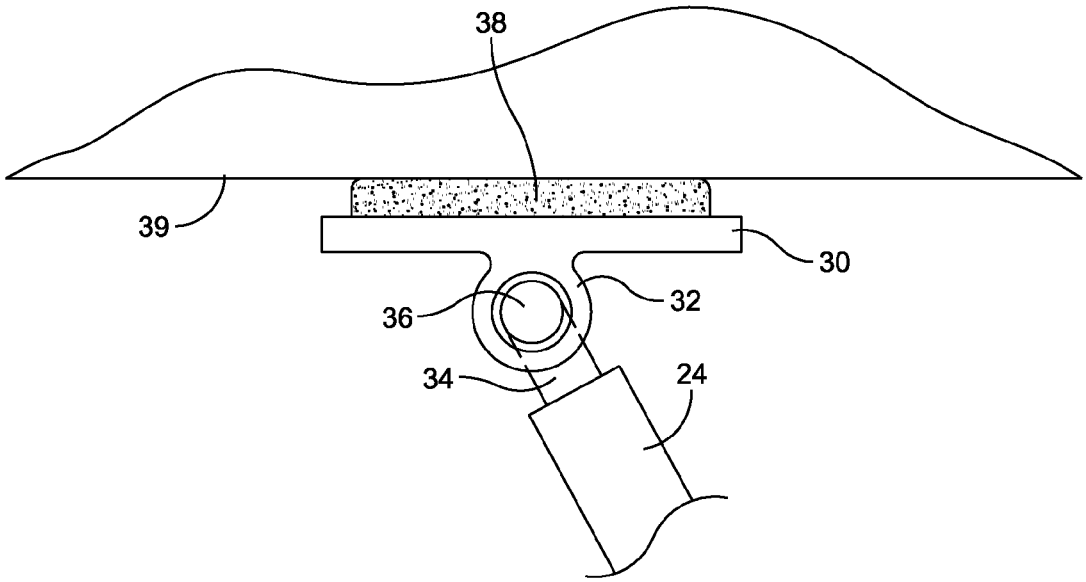
FIG. 6 is plan view of the embodiment of FIG. 5.

Reference is now made to a further embodiment of the present invention in which, in place of the cushioning member 26, there is provided a hinge arrangement as illustrated in FIGS. 5 and 6. This includes a main support plate 30 that carries a hinge piece 32. The end of the flexible rod 24 is provided with a T-shaped connection 34 that includes a hinge pin 36. The opposite side of the base piece 30 is provided with a resilient pad member 38 that is appropriately attached to the base piece 30. FIGS. 5 and 6 illustrate the pad member 38 secured against the side wall surface 39. As with the embodiment described in FIGS. 1-4, in this embodiment, the flexible rod 24 also has a length, including its associated hinge member, that is greater than the distance between the opposed side walls. Thus, this arrangement also provides for a bulging of the flexible rod 24 as in the manner previously described in connection with FIGS. 1 and 2.

Figure 7:
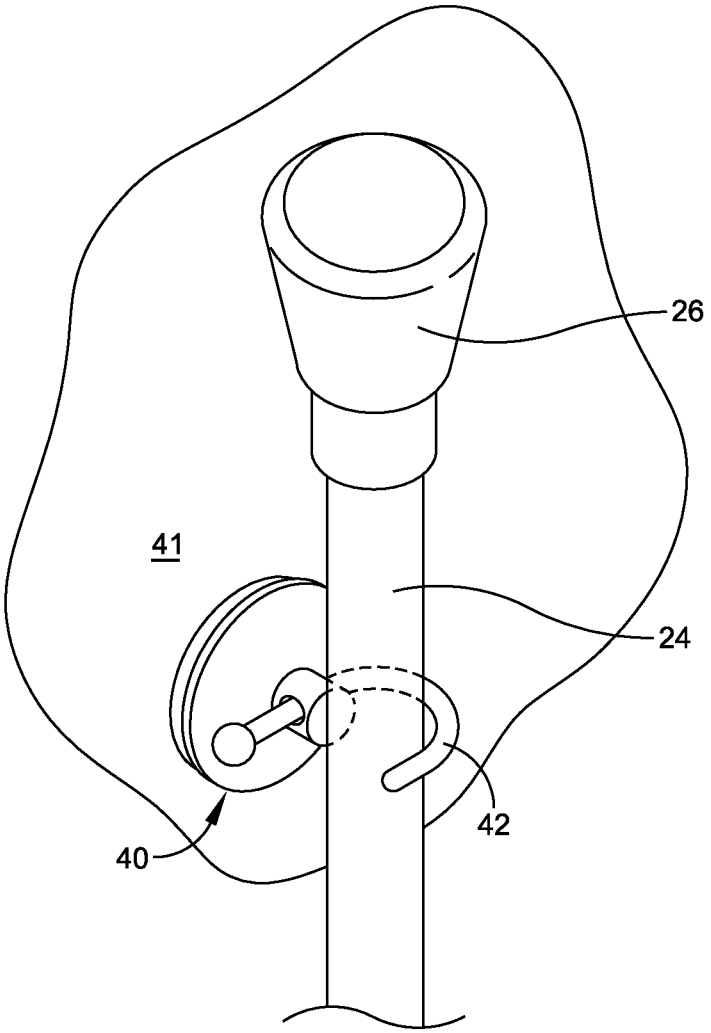
FIG. 7 is an accessory that may be used with the flexible rod for the support thereof when not in use.

Reference is now made to FIG. 7 that is a fragmentary view illustrating a manner in which the flexible rod 24 may be stored when not in use. For this purpose, there is provided an attachment member 40 that may have an adhesive backing for securing to a wall surface 41. The attachment member 40 includes a hook 42 into which the shaft of the flexible rod may be inserted for the purpose of supporting the flexible rod member in an upright position and in close proximity to the tub or shower enclosure area.

Figure 8:
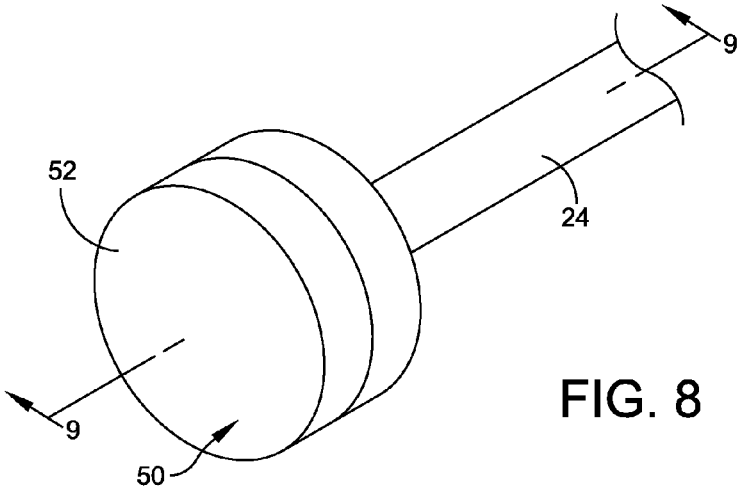
FIG. 8 is a fragmentary perspective view of still another embodiment of the present invention.
Figure 9:
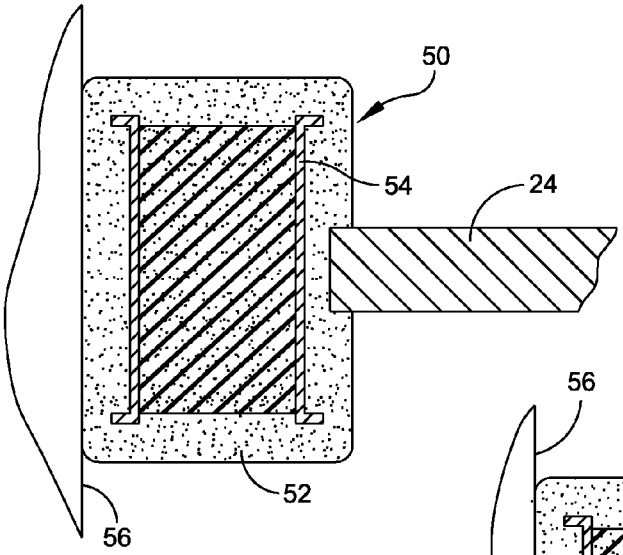
FIG. 9 is a cross-sectional view take along Line 9-9 of FIG. 8.
Figure 10:
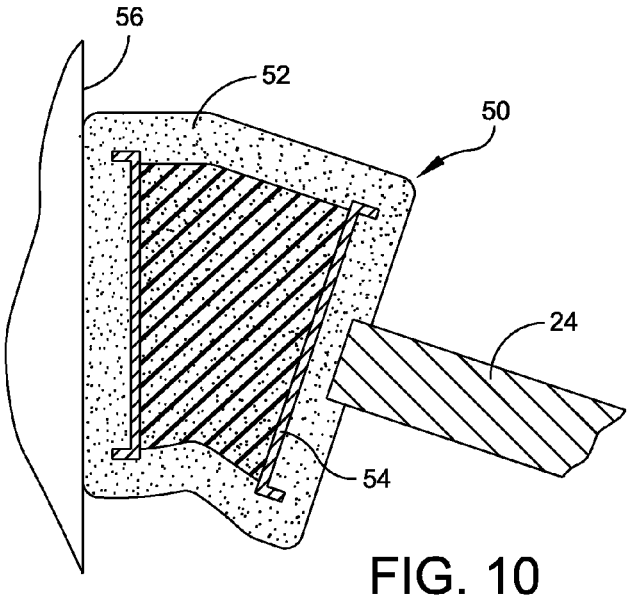
FIG. 10 is a cross-sectional view similar to that shown in FIG. 9, but with the rod flexed.

Reference is now made to FIGS. 8-10 for still another embodiment of the present invention. This also illustrates a flexible rod 24 having at each end thereof a flexible retaining member 50. The member 50 is appropriately attached to the very end of the flexible rod 24. Preferably, although not required, similar structures may be provided at each end of the flexible rod 24 in this embodiment. The retaining member 50 is comprised of an outer rubber piece 52 and an inner piece 54 that may be constructed of a lightweight metal material. The piece 54, in cooperation with the rubber piece 50, enables a certain amount of flexure while maintaining the rubber piece 52 firmly against the wall surface 56. The inner metal piece 54 may be provided in many different configurations and may have different shapes such as circular, square, and rectangular configurations. The inner metal piece 54 supports an inner member illustrated in the drawings connection between the spaced apart pieces 54.

Figure 11:
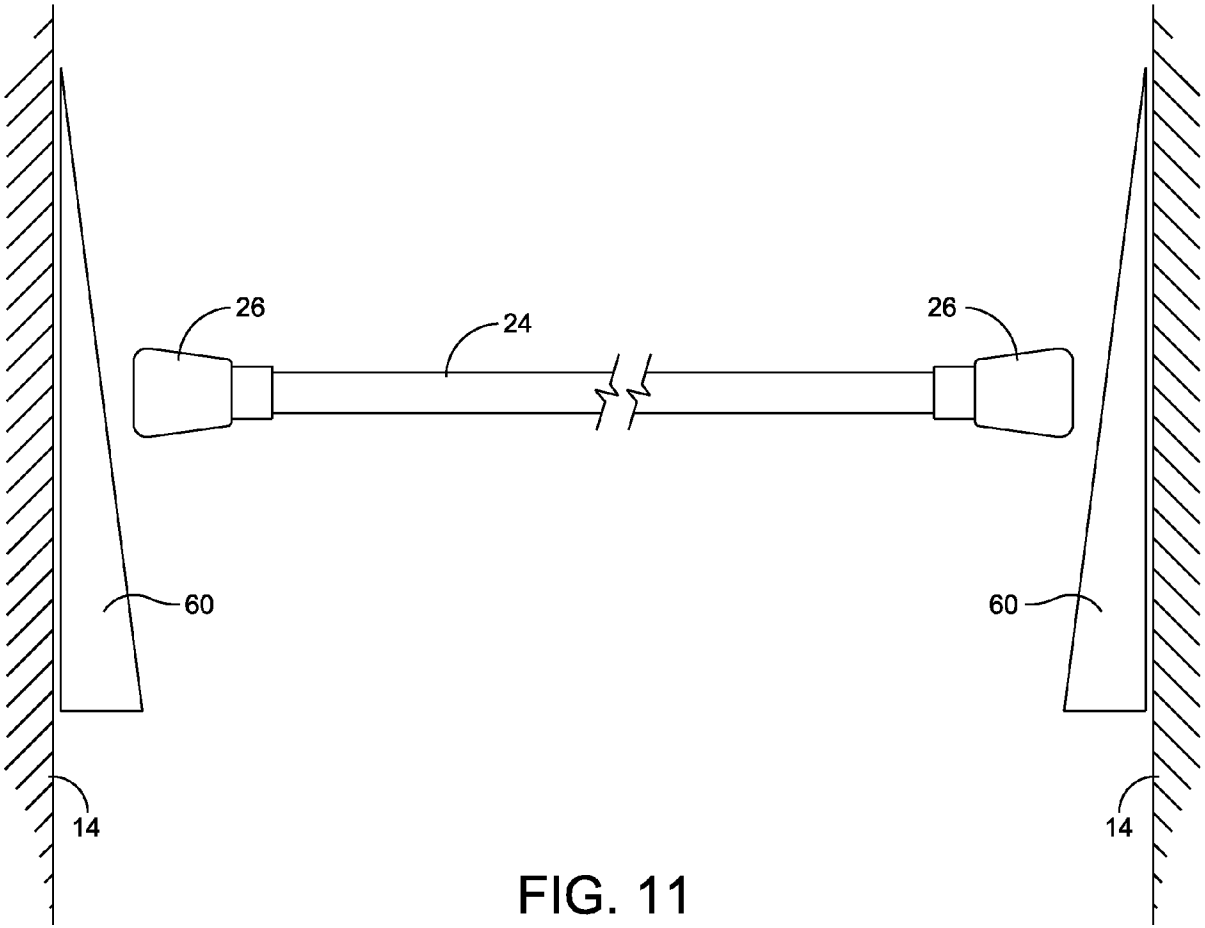
FIG. 11 illustrates still another embodiment of the present invention employing separate wedge members.

Reference is now made to still another embodiment of the present invention illustrated in FIG. 11. In this particular embodiment, the basic flexible rod 24 may be employed with its end cushioning members 26. In this embodiment, the rod 24 may be constructed in the same manner as previously described so that it can flex in an arc. This flexure can come about by the use of a pair of oppositely disposed wedge members 60. Each wedge member 60 may be appropriately attached to an inwardly facing wall of the side walls 14. By engaging the opposite cushioning members 26 with the ramp surface of the wedge members 60, the flexible rod 24 may be moved into an arced position such as illustrated in FIG. 1. Each of the wedges 60, with respect to the position of FIG. 1, may have the thinner part of the ramp of the wedge member 60 at an outer side of the enclosure, or the wedge members may face in the opposite direction, or essentially in any direction. Preferably, the wedge members on either side face in the same direction. Also, one may provide a wedge member on only one side of the enclosure.

Figure 12:
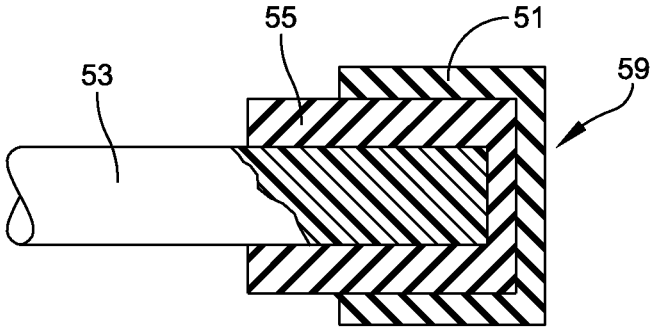
FIG. 12 is a fragmentary end view of an alternate embodiment.

Refer also now to further embodiments of the present invention in FIGS. 12 and 13. This involves a suction cup attachment with a cord or thread 66 that enables disengagement of the rod tip from the shower wall. This cord is attached to the suction cup and can be pulled. By pulling or pushing the cord 66, a gap is created on the end of the suction cup 64 allowing air to enter thus relieving the grip of the rod tip with the shower wall. The midsection of the rod is flexible and bends horizontally in either direction as in earlier embodiments. The inside dimension of the boot 59 is made to fit on a ⅜ inch rod 53, 61. Refer to FIG. 12 which illustrates the rod tip 51 that is on each end of the rod 53 making the rod slightly longer than the shower stall. Installing the device is accomplished by squeezing between the two side walls of the shower stall. The rubber or flexible ti 51*p* will "give" allowing the rod to hold tight, keeping the shower curtain away from the shower space. The rod can be installed at any height in the shower. FIG. 12 illustrates the rod as well as the boot construction 59 which is a two piece construction including an inner piece 55 that fits onto the rod and an outer piece or tip 51.

Figure 13A:
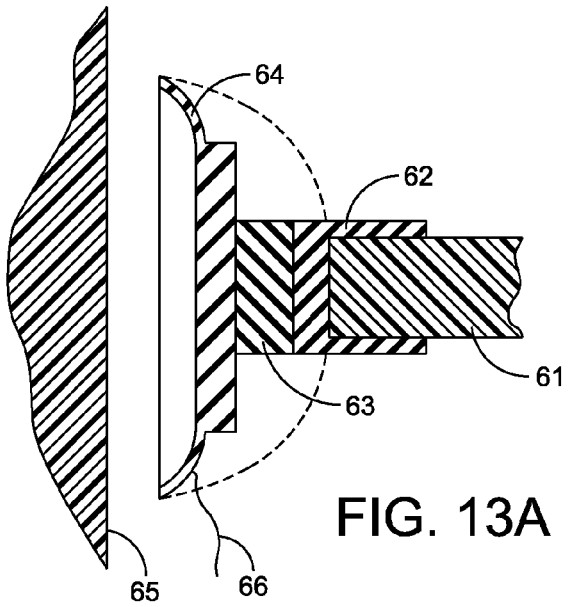
FIGS. 13A, 13B and 13C are three views of the same apparatus using a suction cup arrangement.
Figure 13B:
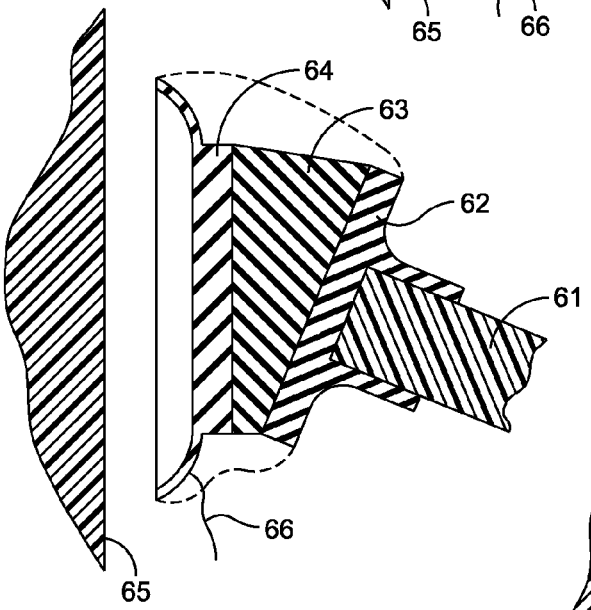
Figure 13C:
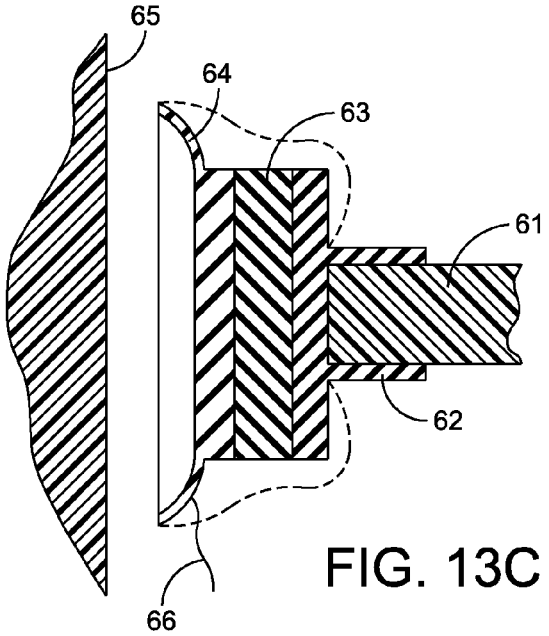
Figure 14:
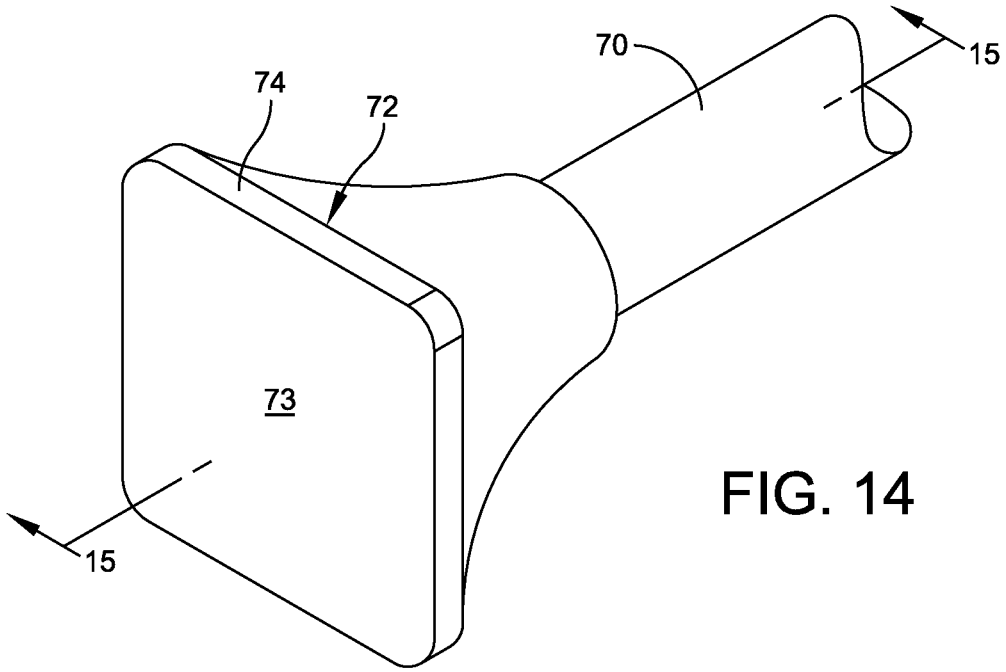
FIG. 14 is a fragmentary end view of another version of the end piece having a square configuration.
Figure 15:
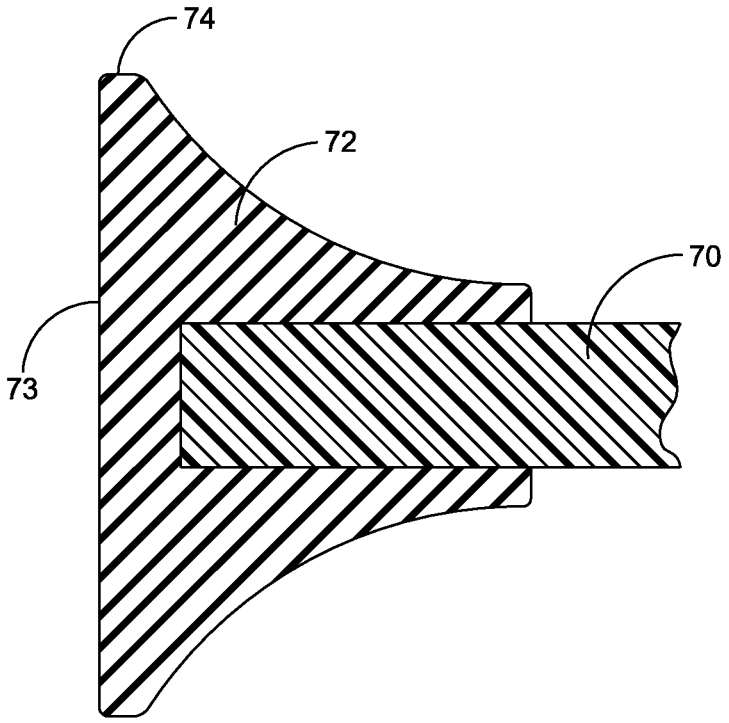
FIG. 15 is a cross-sectional view taken along line 15-15 of FIG. 14.

Refer now also to FIGS. 13A, B and C. This shows further details. In this diagram the reference numbers are as follows: 61) flexible rod; 62) firm rubber like piece; 63) flexible rubber like piece that bends left or right; 64) firm rubber piece with a suction cup attachment; 65) shower wall; and 66) nylon pull thread or cord. The arrangement illustrated in FIG. 13 is designed to cling to the shower wall with essentially a suction cup 64. The rod tip bends in the middle from the pressure of the flexed rod allowing a substantial grip against the shower walls thus allowing the rod to flex outwardly in a horizontal position against the shower curtain. FIG. 13A shows a top view; FIG. 13B shows a side view in the bent position; and FIG. 13C is a further side view in the normal position. For illustration purposes the rod construction is shown separated from the shower wall. FIG. 13 also illustrates a nylon thread 66. This thread or cord is attached to an end of suction cup 64. By pushing or pulling the cord, air enters the suction cup releasing its grip.

Reference is now made to FIGS. 14-20 for a further embodiment of the present invention. This embodiment relates to some extent to the embodiment illustrated in FIG. 11 in that it employs the cushioning member 72 at each end of the flexible support shaft pr rod 70. In this particular embodiment there is a substantially square contact surface 73 and an outer peripheral surface 74 including four equal length straight sides. In addition to this surface 73 being square, it may also be rectangular and possibly even triangular in shape. The contact surface is meant to have straight sides such as illustrated at 74 in FIG. 14. The straight sides are important in connection with engagement with the wedge member, as described hereinafter.

Figure 17:
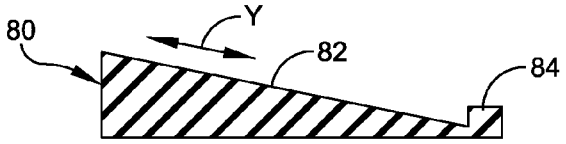
FIG. 17 is a cross-sectional view take along Line 17-17 of FIG. 16.
Figure 18:
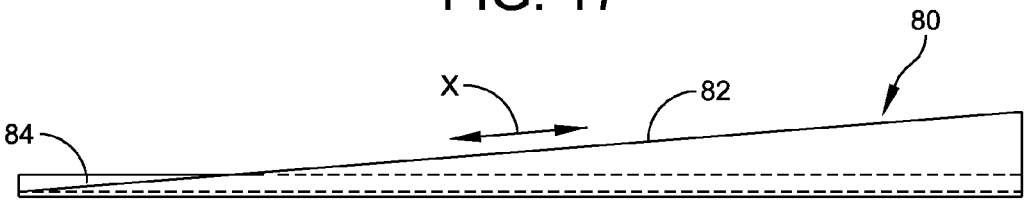
FIG. 18 is a cross-sectional view take along Line 18-18 of FIG. 16.
Figure 19:
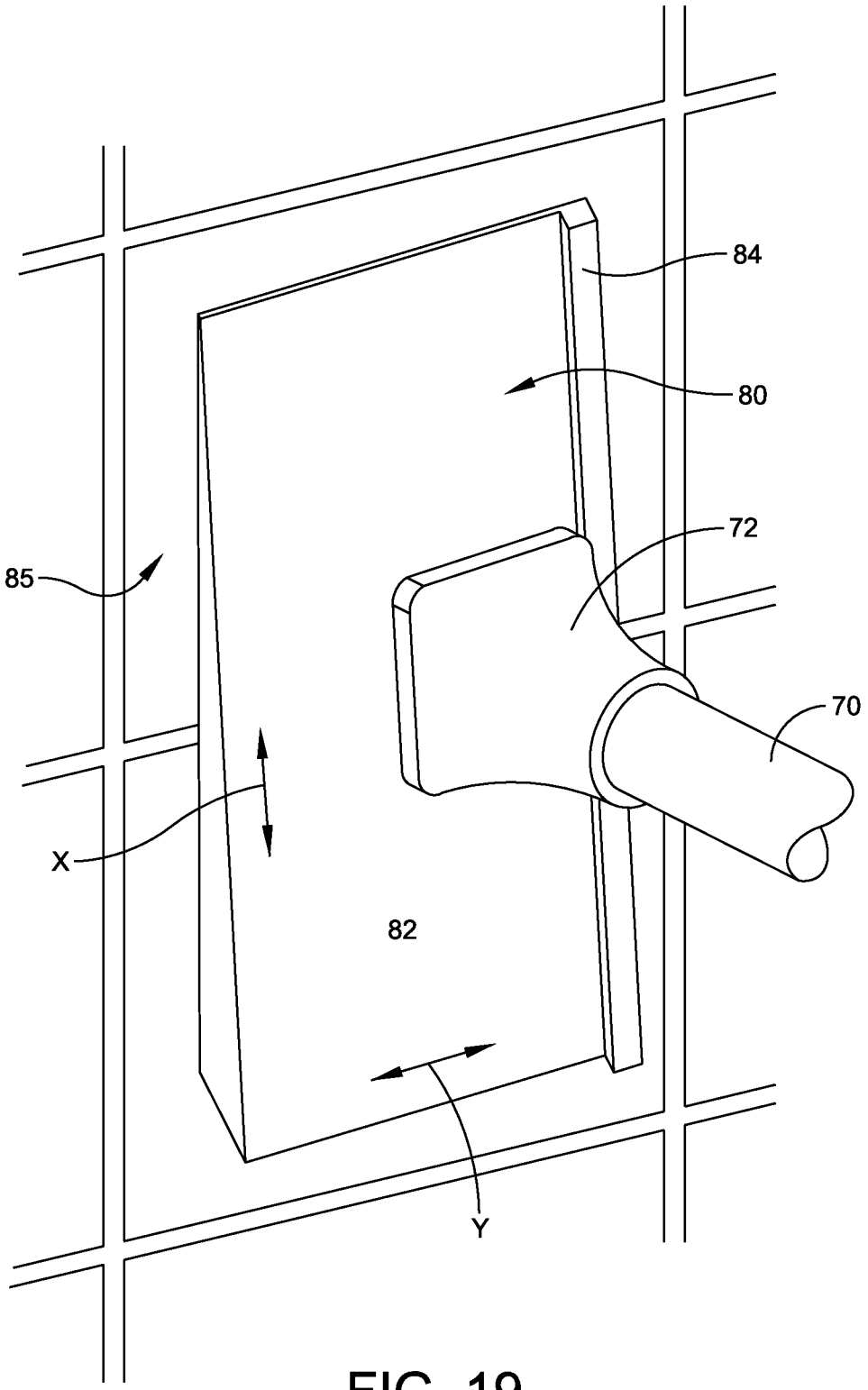
FIG. 19 illustrates the flexible member as secured to a wedge on a shower stall side wall.
Figure 20:
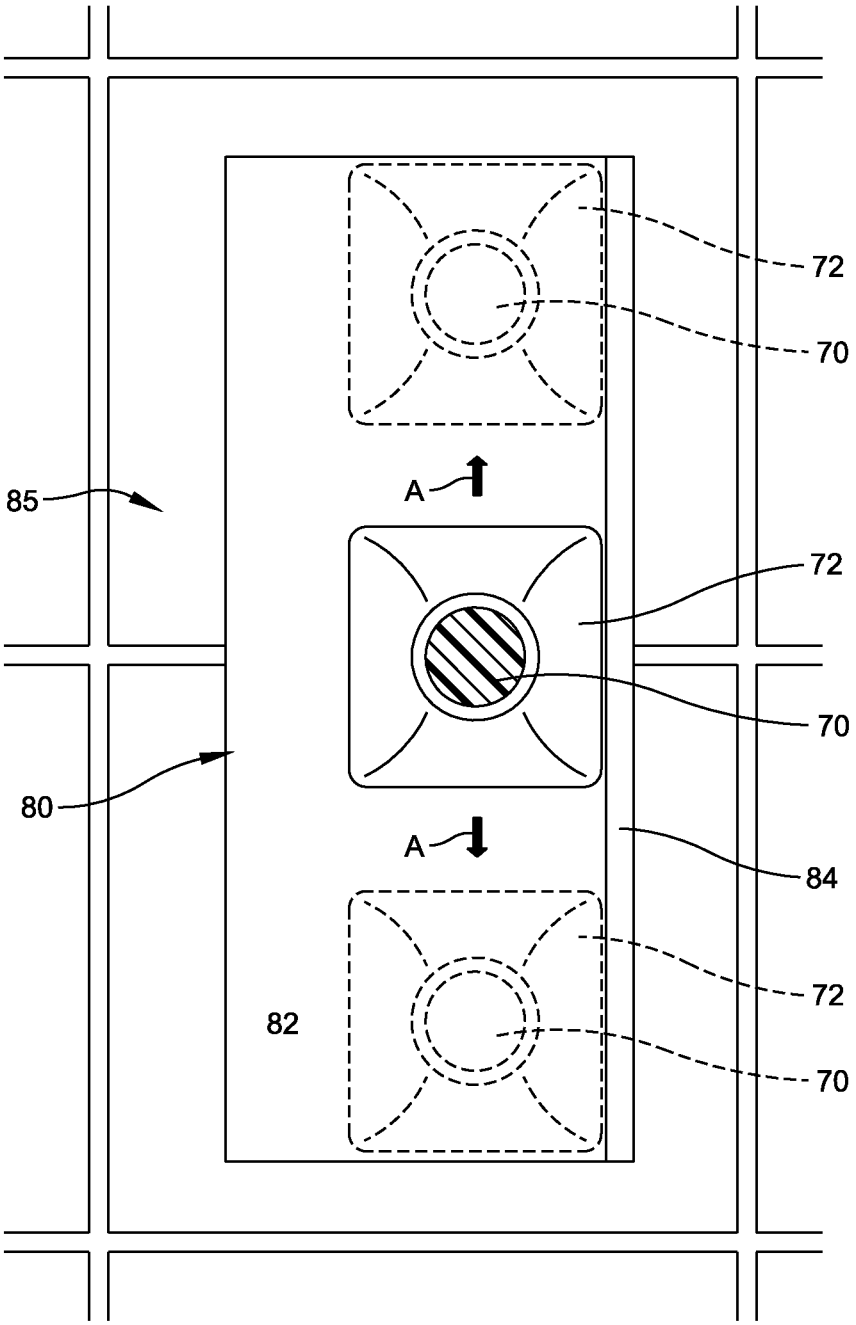
FIG. 20 is a side elevation view depicting different positions of the end piece.

Reference is now made to FIGS. 16-19 for a description of the wedge member 80 that includes a ramp surface 82 and a lip 84 at the bottom end of the ramp surface 82. FIG. 19 in particular shows the wedge member appropriately secured to the side wall 85 of the shower stall. The wedge member 80 may be secured by means of an adhesive backing on the flat bottom surface of the wedge member. Other securing means may also be provided such as rigid fasteners. In FIG. 19 it is noted that the cushioning member 72 of the flexible rod arrangement has one of its straight sides in engagement with the lip 84. In this regard, refer also to the side view of FIG. 20 that illustrates the flexible rod member and the wedge member. FIG. 20 illustrates the flexible rod in an intermediate position. In addition, arrows A indicate that the flexible rod can be repositioned either upwardly or downwardly, but in each position the straight side wall of the cushioning member is an engagement with the straight walled lip 80.

The wedge arrangement shown in FIGS. 14-20 may be positioned at a number of different positions. FIG. 19 shows a position wherein the wedge ramp is facing in a downward-upward direction and wherein the lip 84 is on the inside of the shower stall. As indicated previously, the flexible rod 70 is bendable so as to be secured in position. In this particular embodiment the combination of the rod 70 and the cushioning member 72 need not necessarily be longer than the distance between opposed side walls. However the bending of the rod 70 is accomplished by virtue of sliding the cushioning member downwardly against the ramp surface 82. The further down the ramp the cushioning member moves, the more the bend in the flexible rod 70. At the same time, the engagement of the cushioning member 72 with the lip 84 provides a rather fixed positioning of the flexible rod member, once in the bet position.

As indicated previously, in FIG. 19 the ramp has its smaller depth at the top and the cushioning member 72 is moved downwardly in order to bow out the flexible rod. The wedge member may also be positioned differently such as in an opposed direction in which case the cushioning member would be moved upwardly to the deeper portion of the ramp in order to bow out the flexible rod. Theoretically, the wedge member may be also disposed in other positions such as even an orthogonal position to that illustrated in FIG. 19. However, in all positions, the straight side of the cushioning member is meant to engage the straight portion of the lip so as to provide proper alignment between the flexible rod construction and the wedge member, and the rod is moved "up" the wedge to bow out the rod.

Another preferred feature of the wedge member of the present invention is illustrated at 80 in FIGS. 16-19 wherein the ramp surface 82 has a taper in orthogonal directions. This includes elongated taper in the direction X shown in FIG. 19, as well as a shorter orthogonal taper in the direction Y shown also in FIG. 19, as well as in FIGS. 16-18. Thus, as the end piece 72 is slid along the wedge member it is essentially directed in both taper directions to direct the end piece against the wedge lip 84. It is the movement of the rod in direction X that primarily accounts for the bowing out of the flexible rod. The "Y" taper primarily provides the urging toward the lip 84.

Figure 16:
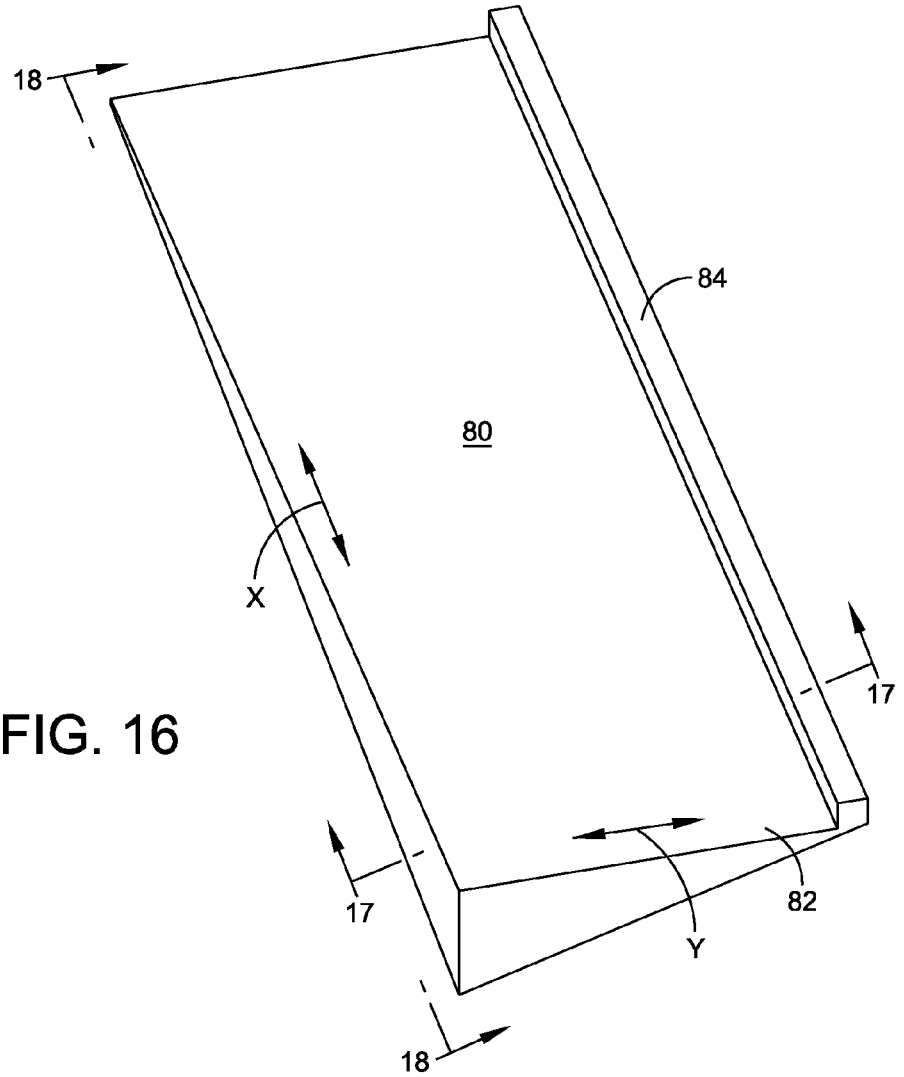
FIG. 16 is a perspective view of the wedge member.
Figure 21:
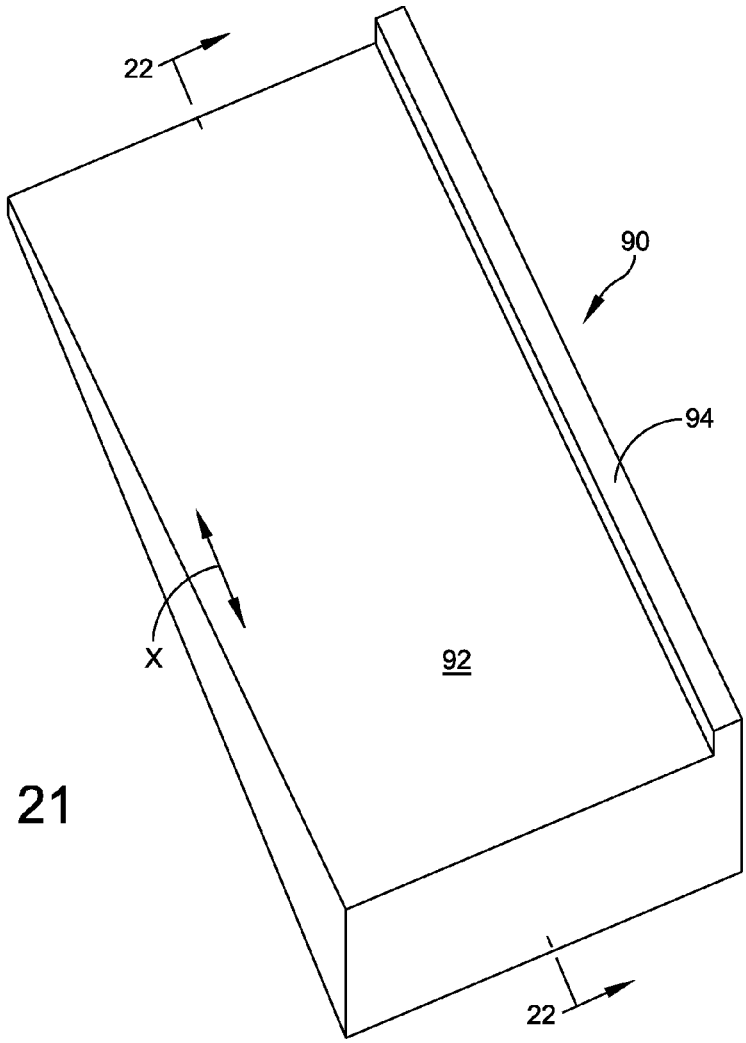
FIG. 21 is a perspective view of still a further embodiment of the present invention.
Figure 22:
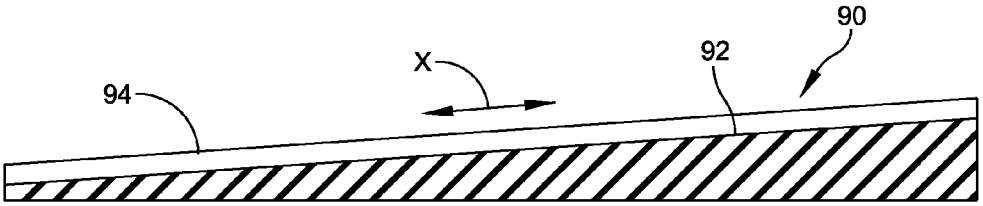
FIG. 22 is a cross-sectional view taken along line 22-22 of FIG. 21.
Figure 23:
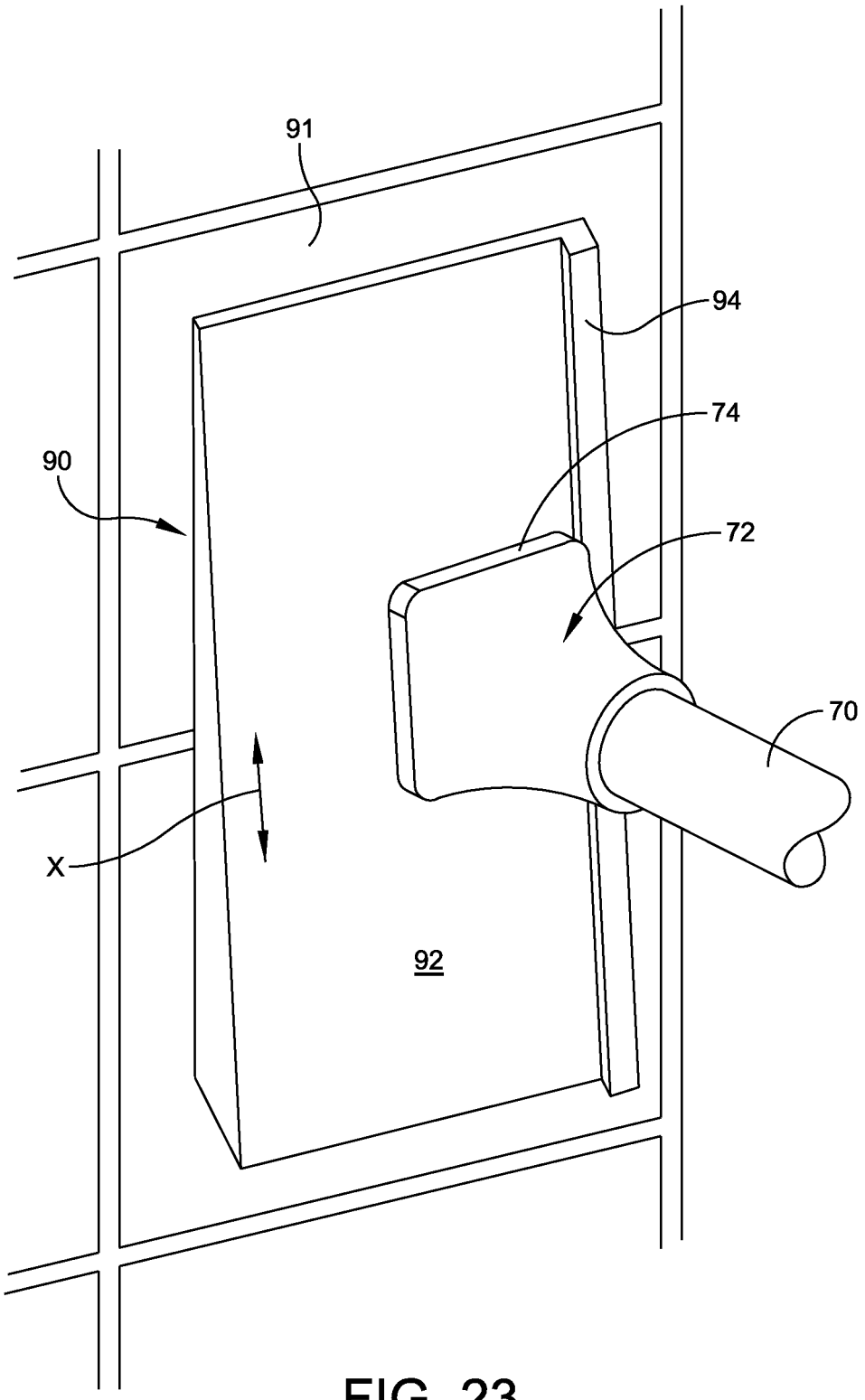
FIG. 23 is a perspective view showing the wedge member in place in the bath enclosure.

Reference is now made to FIGS. 21-23 for a description of another embodiment of the present invention which is similar to the embodiment described in FIGS. 16-18. This embodiment includes a wedge member 90 that has a flat bottom and a top ramp surface 92. On one side of the ramp surface 92 that is an upwardly extending lip 94. FIGS. 21 and 22 illustrate this construction. FIG. 23 shows the wedge member 90 as positioned on a bath enclosure wall 91. As with other embodiments described herein, the wedge member can assume a number of different positions including upwardly and downwardly ramped positions and positions transverse thereto. FIG. 23 shows the flexible rod 70 and the end cushioning member 72 as positioned on the ramp 92. The wedge member described in FIGS. 21-23 differs from the construction in FIGS. 16-18 in that there is only a single ramp direction illustrated by X in FIG. 23. The flexing of the rod, as in earlier embodiments, occurs by means of moving the cushioning member up the associated ramp 92. This essentially closes the distance between the respective ends of the flexible rod thus causing the flexible rod to bow out such as to a position illustrated in FIG. 1.

Figure 24:
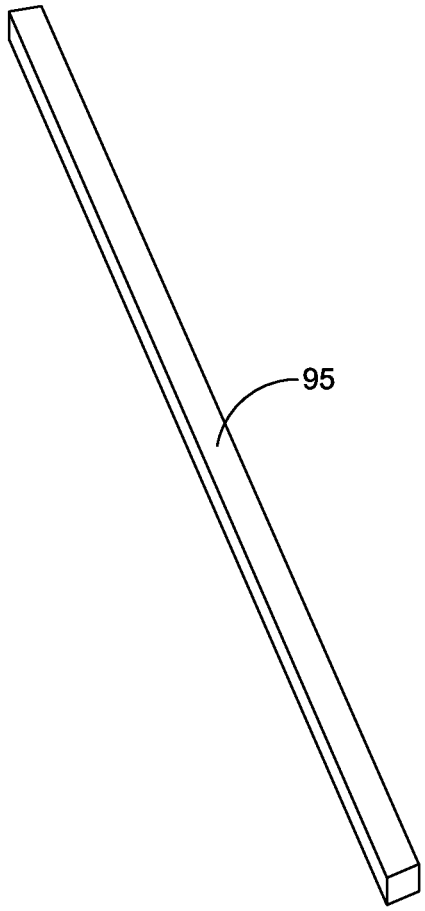
FIG. 24 illustrates the use of a lip member alone.
Figure 25:
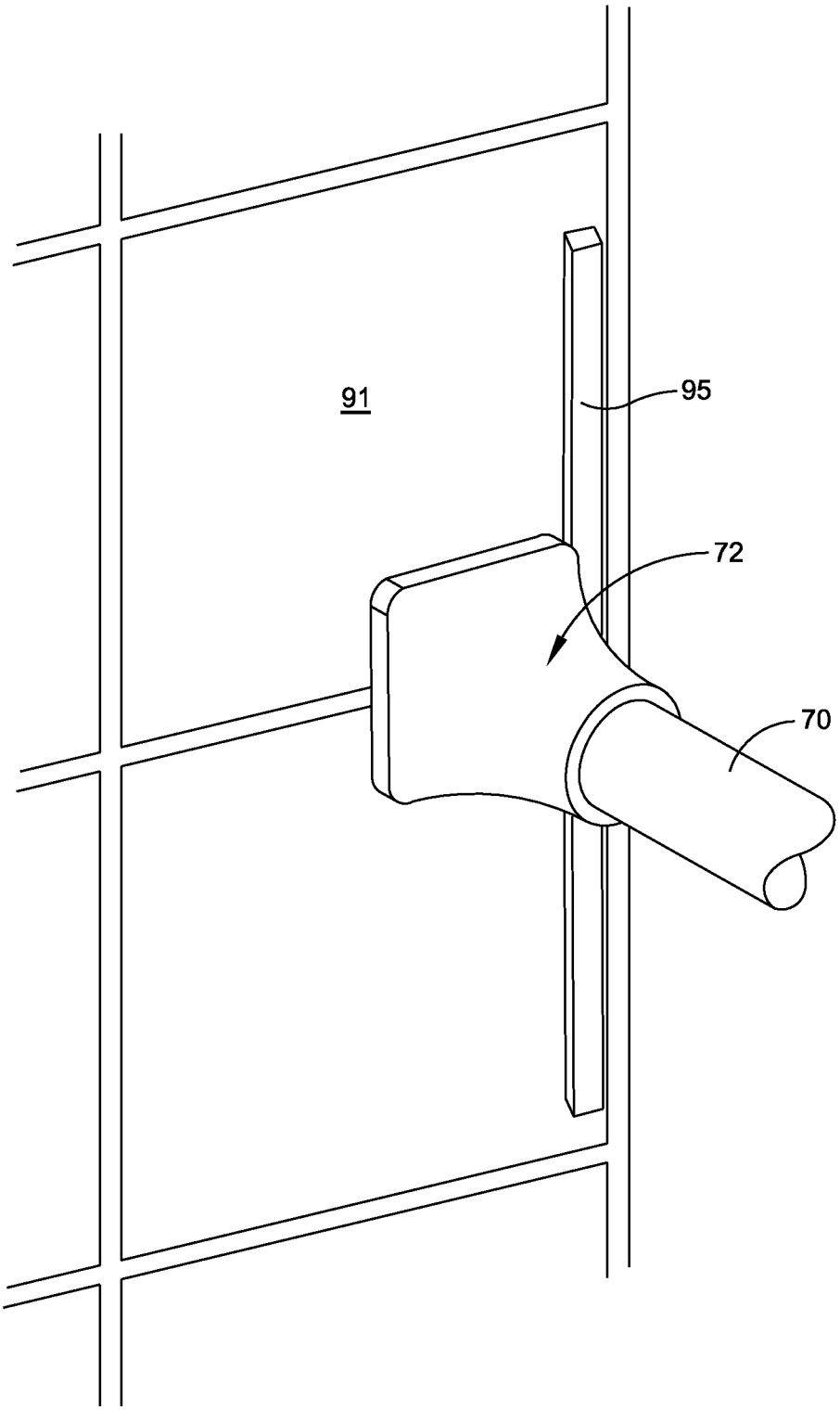
FIG. 25 is a perspective view illustrating the lip member and associated flexible rod.
Figure 26:
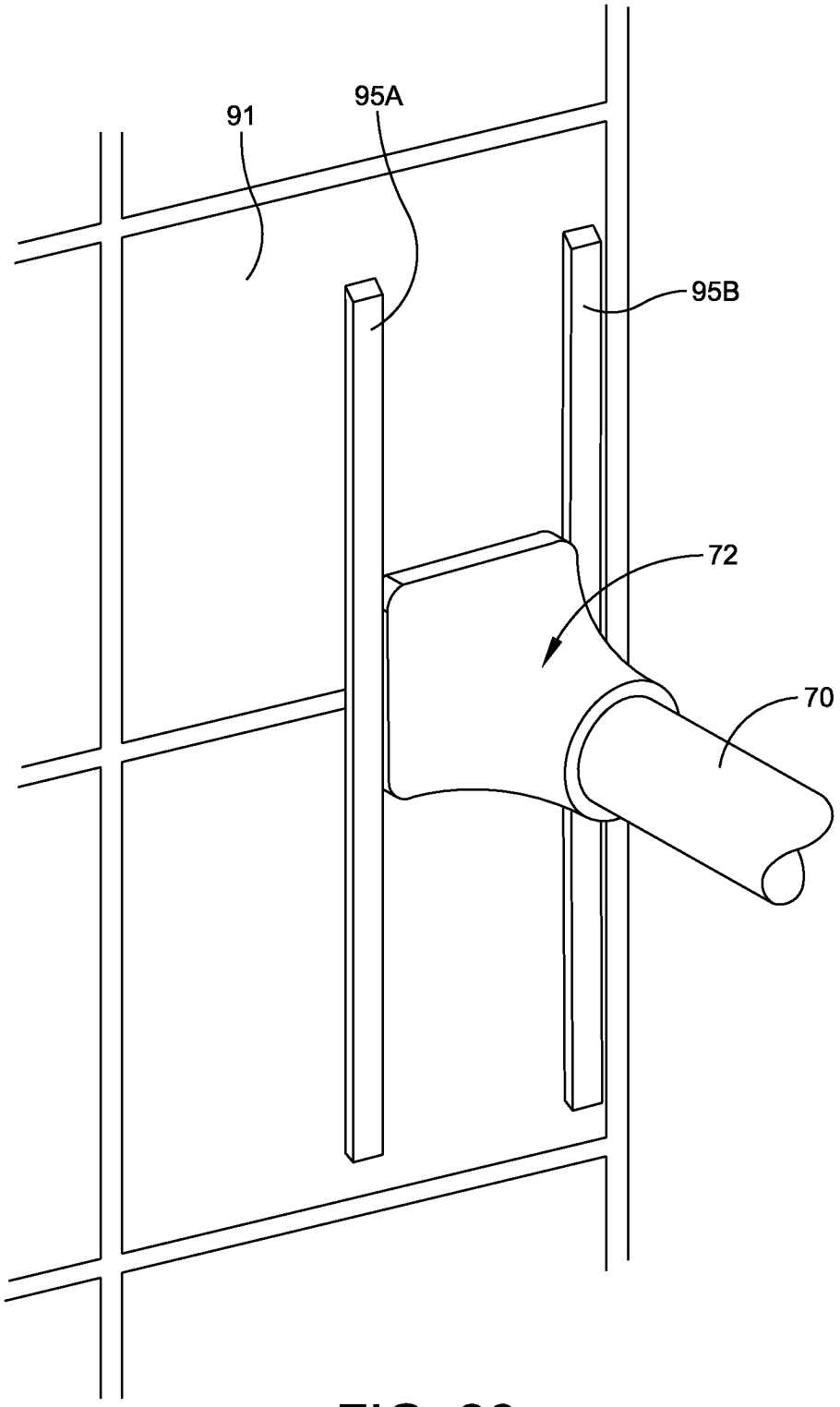
FIG. 26 is another embodiment of the present invention in which a pair of lip members are used with the cushioning member disposed between these lip members.

Refer now to FIGS. 24 and 25 for still another embodiment of the present invention. This embodiment simply employs an elongated strip or lip 95. The lip 95 is illustrated in the perspective view of FIG. 25 as attached by appropriate means to the wall of the shower. FIG. 25 also illustrates the flexible rod 70 and the end cushioning member 72. One of the straight sides of the cushioning member 72 is urged against the side of the lip 95 to hold the cushioning member in place. FIG. 26 shows the use of a pair of lips 95A, 95B. These are spaced apart a sufficient distance which is substantially equal to the width of the cushioning member so that the cushioning member is firmly positioned between the lips 95A, 95B to hold the cushioning member and thus the flexible rod in position.

Figure 27:
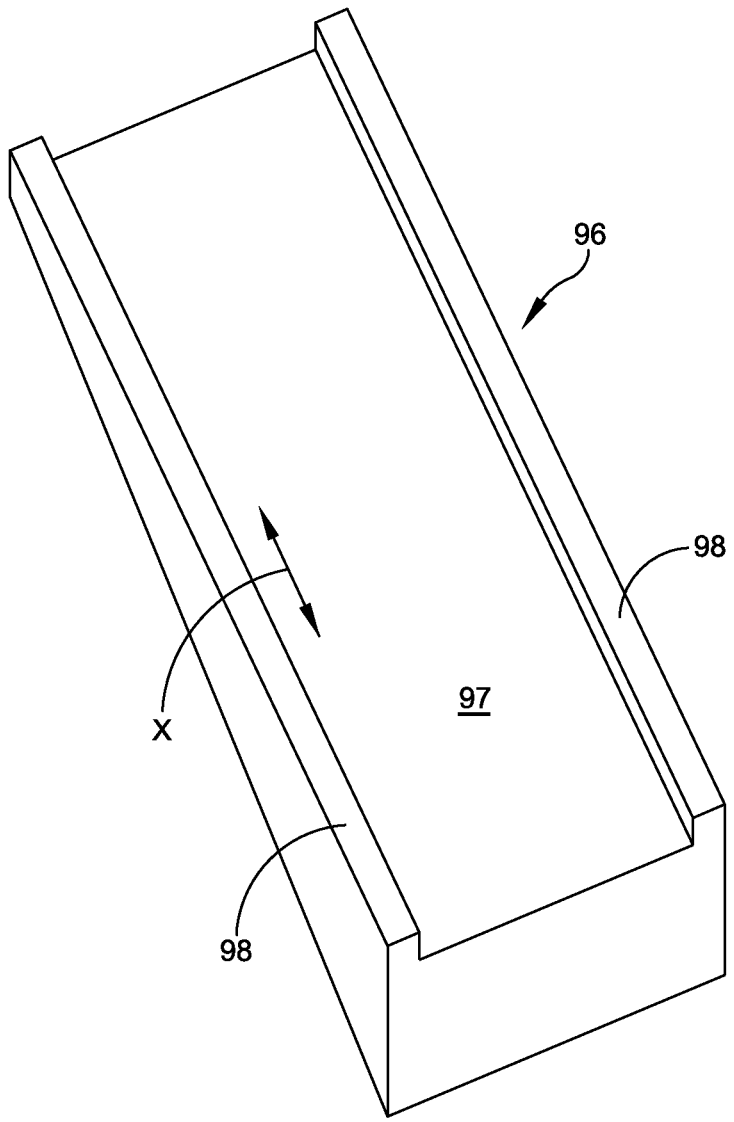
FIG. 27 is still a further embodiment of the present invention in which the wedge member has opposed side lips.
Figure 28:
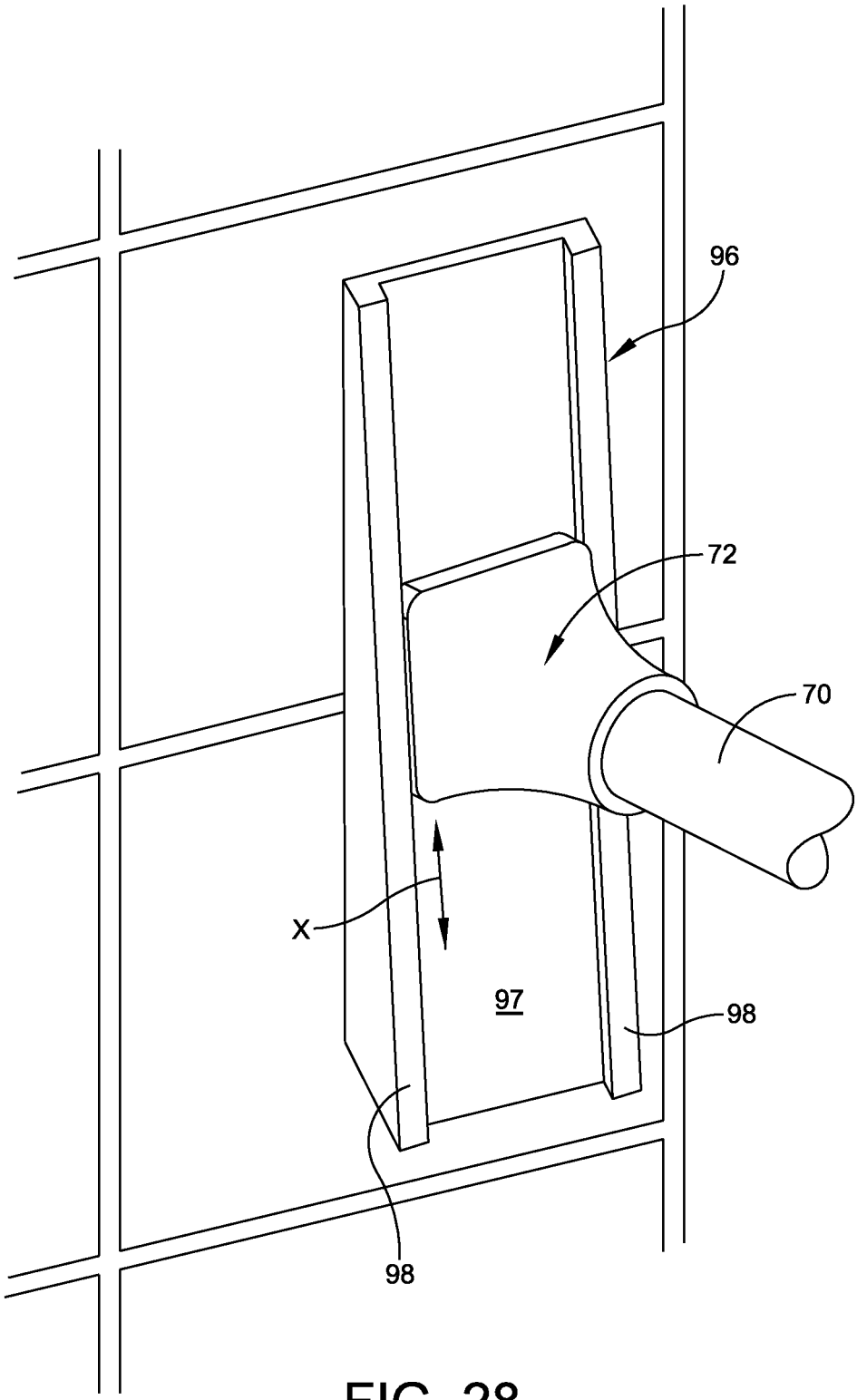
FIG. 28 is a perspective view showing the wedge of FIG. 27 in use.

A final embodiment of the present invention is illustrated in FIGS. 27 and 28. This is comprised of a wedge member 96 having a ramp surface 97 and oppositely disposed lips 98. The ramp surface illustrated in FIGS. 27 and 28 functions substantially the same as the surface 92 previously described in connection with FIGS. 21-23. However, in this embodiment the use of a pair of lips 98 restricts the motion of the cushioning member 72 maintaining the cushioning member between the lips while at the same time allowing the cushioning member and flexible rod to move upwardly on the wedge surface 97 in the direction of the arrow X as shown in FIG. 28.

Figure 29:
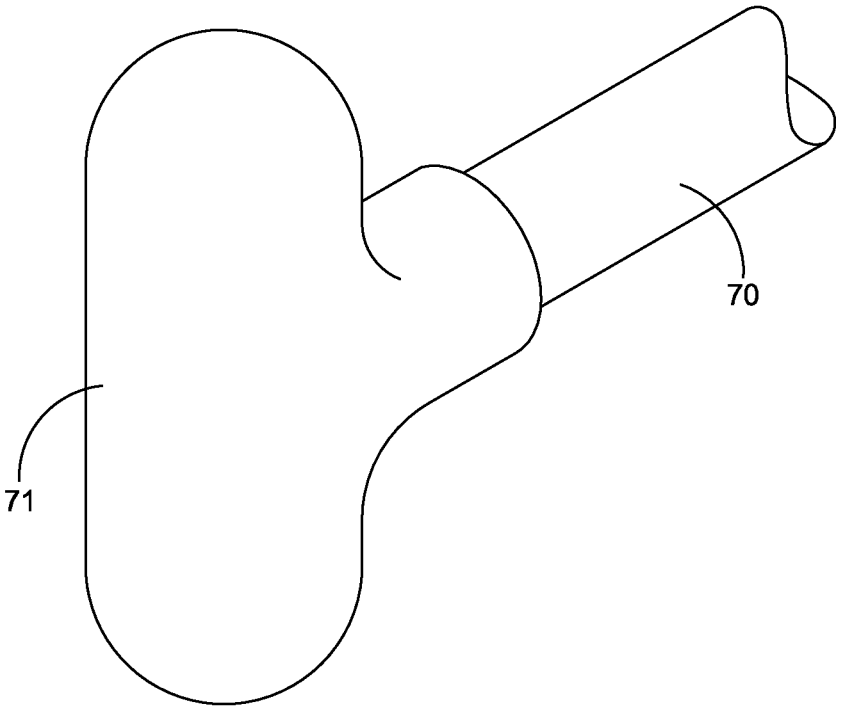
FIG. 29 shows an alternate cushioning member.

Another alternate arrangement relates to the embodiment described in FIG. 26 wherein two strips 95A and 95B have been used. Although not illustrated in FIG. 26, one or more joining members may interconnect between these strips so as to hold the strips in a fixed spaced distance apart like that shown in FIG. 26. For example, a connecting strip could be at both the top and bottom of the strips illustrated in FIG. 26 extending substantially orthogonal to the length of the strips. Refer also to an alternate cushioning member illustrated in FIG. 29. This shows the end piece 71 with an oval shape. In the embodiment of FIG. 29, another alternate embodiment is where the main flexing rod is of a different shape than a circular cross-section. For example, the rod may be rectangular in shape with the narrower portion of the rod being in alignment with the narrower portion of the cushioning member. The rod is thus flexible in the direction of the narrower portion of the rod.

It is also noted that the various components, such as illustrated in FIGS. 23-28 are disposed against a shallow wall. It is preferred that these be disposed at the inlet edge of the shallow wall so that the bowed rod will provide a maximum access area within the shower. Also, in the various width constructions that are shown herein, as well as with respect to the separate strips, it is preferred to provide a peel off adhesive structure on the back. This would enable one to peel off a covering on the back of the component and then attach the component by a sticky adhesive to the shower wall.

Having now described a limited number of embodiments of the present invention, it should now be apparent to those skilled in the art that numerous other embodiments and modifications thereof are contemplated as falling within the scope of the present invention, as defined by the appended claims. For example, another embodiment of the present invention may employ a flexible rod 20 having end spring-loaded members that would normally bias the very ends to a dimension greater than the length between the sidewalls. As the ends are urged inwardly against the spring bias, the ends are then placed at the opposed sidewalls while the flexible rod itself is in a curved configuration as illustrated in FIGS. 1 and 2. This spring bias arrangement may also be applied to the cushioning member shown in FIGS. 14-20.

What is claimed is:

1. A shower curtain enlarger apparatus kit comprising:

a flexible rod that is constructed and arranged for positioning between opposed side walls of a shower stall;

and a pair of end pieces attached respectively to opposed ends of the flexible rod;

the combined length of the flexible rod with the attached end pieces constructed and arranged to have a length greater than the distance between the opposed side walls of the shower stall;

whereby the flexible rod is positioned between the opposed side walls by means of bending the flexible rod to fit between the opposed side walls and with the bending being directed away from the shower stall to enhance an inner use space in the shower stall;

and a separate wedge member that is secured to the shower stall sidewall, having opposed ends and having a planar ramp surface extending between the opposed ends and for receiving one of the end pieces, wherein the wedge member tapers in a flat plane between the opposed ends of the wedge member.

2. The shower curtain enlarger apparatus of claim 1 wherein the end piece comprises a cushioning member.

3. The shower curtain enlarger apparatus of claim 2 including one or more extender pieces attached to the cushioning member to extend the combined length of the flexible rod and cushioning members.

4. The shower curtain enlarger apparatus of claim 3 wherein each of the extender pieces has an adhesive with a peel-off member.

5. The shower curtain enlarger apparatus of claim 1 wherein the wedge member has opposed sides, and also includes an elongated linearly extending upright lip that is disposed along one of the opposed sides and extends between the opposed ends of the wedge member.

6. The shower curtain enlarger apparatus of claim 1 wherein the end piece comprises a flexible retaining member.

7. The shower curtain enlarger apparatus of claim 6 wherein the flexible retaining member comprises an outer rubber piece and an inner metal piece supporting the outer rubber piece.

8. The shower curtain enlarger apparatus of claim 1 wherein the wedge member has opposed sides, and also includes a first elongated linearly extending upright lip that is disposed along one of the opposed sides and extends between the opposed ends of the wedge member.

9. The shower curtain enlarger apparatus of claim 8 including a second elongated linearly extending upright lip that is disposed along an opposed side of the wedge member, spaced from the first elongated linearly extending upright lip and in parallel with the first elongated linearly extending upright lip.

10. The shower curtain enlarger apparatus of claim 8, wherein the wedge member planar ramp surface tapers in both a first direction between the opposed ends and in a second direction between the opposed sides.

11. The shower curtain enlarger apparatus of claim 10 wherein the end piece comprises a cushioning member having multiple straight sides.

12. The shower curtain enlarger apparatus of claim 11 wherein the lip on the wedge member has a straight edge that is engaged by one of the straight sides of the cushioning member.

13. The shower curtain enlarger apparatus of claim 1 wherein the wedge member has opposed sides orthogonal to the opposed ends and the planar ramp surface tapers in both a first direction between the opposed ends and in a second orthogonal direction between the opposed sides.

14. The shower curtain enlarger apparatus of claim 13 wherein the end piece comprises a cushioning member that is one of square, rectangular and triangular.

15. The shower curtain enlarger apparatus of claim 13 wherein the wedge member also includes a first elongated linearly extending upright lip that is disposed along one of the opposed sides and extends between the opposed ends of the wedge member.

16. The shower curtain enlarger apparatus of claim 15 including a second elongated linearly extending upright lip that is disposed along an opposed side of the wedge member.

17. The shower curtain enlarger apparatus of claim 16 wherein the second elongated linearly extending lip is spaced from the first elongated linearly extending upright lip.

18. The shower curtain enlarger apparatus of claim 17 wherein the second elongated linearly extending lip is disposed in parallel with the first elongated linearly extending upright lip.

19. The shower curtain enlarger apparatus of claim 1 including a further wedge member secured at an opposed side wall of the shower stall.

* * * * *